US005308006A

United States Patent [19]

Hehner

[11] Patent Number: 5,308,006

[45] Date of Patent: May 3, 1994

[54] DEVICE FOR WINDING-UP MATERIAL WEBS

[75] Inventor: Reinhard Hehner, Haan, Fed. Rep. of Germany

[73] Assignee: Jagenberg Aktiengesellschaft, Dusseldorf, Fed. Rep. of Germany

[21] Appl. No.: 807,846

[22] PCT Filed: Mar. 28, 1991

[86] PCT No.: PCT/EP91/00604

§ 371 Date: Jan. 22, 1992

§ 102(e) Date: Jan. 22, 1992

[87] PCT Pub. No.: WO91/17106

PCT Pub. Date: Nov. 14, 1991

[30] Foreign Application Priority Data

May 7, 1990 [DE] Fed. Rep. of Germany ..... 4014512

[51] Int. Cl.[5] ..... B65H 18/16; B65H 35/02

[52] U.S. Cl. ..... 242/56.4; 242/65

[58] Field of Search ..... 242/56.2, 56.4, 65

[56] References Cited

U.S. PATENT DOCUMENTS

| | | | |
|---|---|---|---|
| 2,984,427 | 5/1961 | Rockstrom | 242/65 |
| 3,198,453 | 8/1965 | Aaron | 242/65 |
| 3,350,026 | 10/1967 | Amos | 242/65 |
| 3,503,567 | 3/1970 | Casey | 242/65 X |
| 3,871,598 | 3/1975 | Kataoka | 242/65 |

FOREIGN PATENT DOCUMENTS

| | | |
|---|---|---|
| 0324707 | 7/1989 | European Pat. Off. . |
| 0355171 | 2/1990 | European Pat. Off. . |
| 1506710 | 11/1967 | France . |
| 2497019 | 6/1982 | France . |
| 2622064 | 4/1989 | France . |

*Primary Examiner*—John M. Jillions

*Attorney, Agent, or Firm*—Herbert Dubno; Andrew Wilford; Yuri Kateshov

[57] ABSTRACT

A winding device includes a support roller receiving strips of a material web to be wound up on two coil rollers mounted on respective winding supports flanking the support roller and movable parallel to an axis of the support roller along with respective electric motors actuating respective drive heads and getting cooled by respective flexible carriers movable along with the winding supports.

5 Claims, 1 Drawing Sheet

DEVICE FOR WINDING-UP MATERIAL WEBS

CROSS REFERENCE TO RELATED APPLICATIONS

This application is a national phase of PCT/EP91/00604 filed Mar. 28, 1991 and based upon German National Application P40 14512.3 of May 7, 1990, under the International Convention.

FIELD OF THE INVENTION

The invention concerns a device for the winding-up of material webs, especially paper webs or cardboard (paper board) webs on winding tubes.

BACKGROUND OF THE INVENTION

From the article "Roller Cutters and Roll Machines For the Paper Equipment, Part 3" in COATING 1/89, pages 8–12, a winding up device of this type is known which has a driven support roller and winding stations arranged on both sides of the support roller. Each winding station is comprised of two swingable support arms, each of which is equipped with a respective hydraulic winding drive. The two hydraulic motors of a winding station are connected in parallel and are fed from a hydraulic variable displacement pump.

Hydraulic drives have relatively small sizes for high powers, but it has been found that their use in winding machines brings disadvantages; that is outside of the winding machine large hydraulic installations are required and the adjustment of the winding station in the case of size changes presents problems. Because of the requisite high pressure (for example 300 bar) in the feed piping, these are very stiff and can be brought into the required new positions in a format change only with difficulty. In addition the requisite control is very complex with hydraulic drives.

OBJECT OF THE INVENTION

The object of the present invention is to provide a winding machine having the coiling stations adjusted in a problem free manner to different formats, especially to very small formats.

SUMMARY OF THE INVENTION

Liquid cooled electric motors provide the required acceleration power and braking power with relatively small structural size. The size of the motor is of significance since the support elements (for example rolling brackets) with the motors must be brought to the smallest possible spacing from one another for small format widths. Indeed, the liquid cooled motors require supply piping for the cooled liquid, but the requisite pressure in the piping is significantly less than that for the hydraulic in the supply piping of hydraulic drives. It has been shown that a coolant liquid pressure of 0.1 bar suffices. Because of the low pressure, the supply piping is highly bendable and can have its position adjusted without problems upon a format change.

The dependent claims recite especially advantageous embodiments of the invention. The use of a polyphase [three phase] alternating current asynchronous motor according to one of the embodiments enables an especially small motor volume with high power since, with these motors, the heat generation is effected primarily in the stator coil and control via a frequency converter is least expensive.

BRIEF DESCRIPTION OF THE DRAWING

The above and other objects, features and advantages of the invention will become more readily apparent form the following description, reference being made to the accompanying highly diagrammatic drawing in which.

SPECIFIC DESCRIPTION

Figure 1:
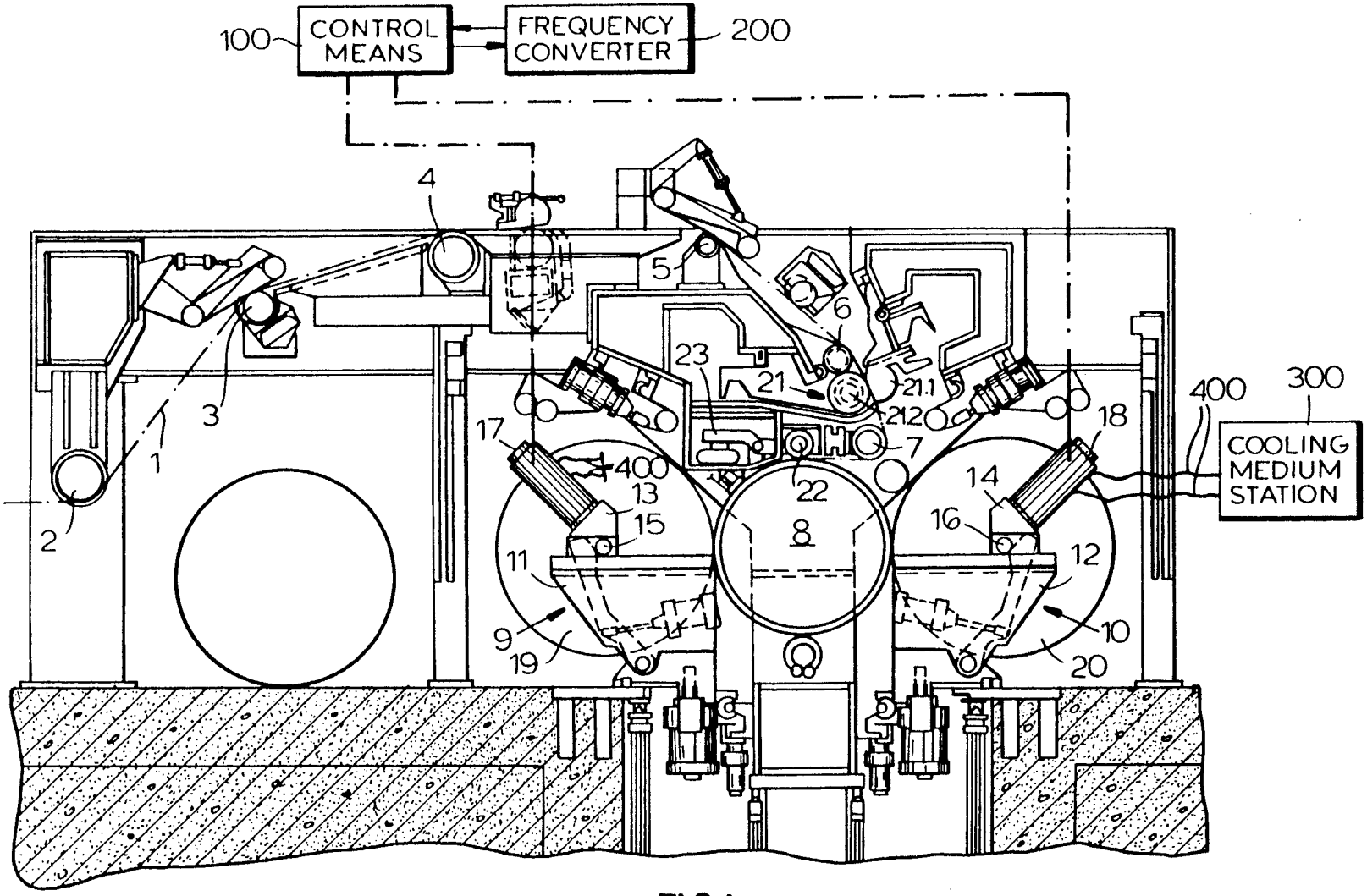
FIG. 1 is a side elevational view of a support roll coiling machine according to the invention.

The material web 1, drawn from a supply roll not illustrated, in the present example a paper web, is fed via guide rollers 2–7 from above onto the driven support roller 8. To both sides of the support roller 8, coiling stations 9 and 10 are arranged and each is comprised of two support elements displaceable parallel to the support roller axis. In the present example, the support elements are coiling brackets 11, 12 although the use of swingable support arms is possible. Each winding bracket 11, 12 carries on its upper side a slide 13, 14 displaceable radially to the support roller 8. A drive head 15, 16 with its rotary drive 17, 18 is fastened. The drive heads 15, 16 are insertable into the coiling sleeves of the coiling rolls 19, 20 to hold and drive them.

Polyphase alternating current asynchronous motors are used as rotary drive 17, 18, the motors having stator windings cooled with water from station 300 by means of flexible carriers 400. A cooling with oil is also possible. For this purpose the housings of the motor 17, 18 are equipped with circulating cooling passages for the cooling liquid. So that the winding brackets 11, 12 can be displaced inwardly as close together as is possible for small formats. The motors 17, 18 have their longitudinal orientations mounted in the web travel direction and are connected via an angle drive with the drive head 15, 16. The drives are each flanged on the motor 17, 18, whereby each flange also has cooling passages. The flange region can thus be cooled in a manner so enhanced that heat developed in the drive will also be carried off.

A control arrangement 100 controls or regulates the coil hardness of the coiled rolls 19, 20 via the torque of the motor 17, 18. For the polyphase asynchronous motors of the example the torque control or regulation is effected via a frequency converter or transformer 200.

Instead of polyphase asynchronous motors, direct current motors or servo motors are usable whose stator coils are cooled with water or oil. Direct current motors however require expensive maintenance because of the wear on carbon brushes and with servo motors expensive control concepts are required. The cooling passages of motor 17, 18 are connected with supply tubing for cooling liquid 400 which is supplied from a common cooling unit 300 outside the coiling machine. The supply tubing on each side of the coiling machine can be gathered into trailing bundles because of the low pressure in the tubing (0.1 bar) which makes the tubing very bendable so that it can be arranged in a space saving manner and can move in a problem free fashion during a format change. Furthermore, the danger of sealing breakdown is minimal at the low pressure.

Above the support roller 8 in a region between the guide rolls 6 and 7, a longitudinal slitting device 21 is arranged and comprises a plurality of circular blade pairs 21.1, 21.2 which are displaceable transversely to the travel direction of the web for the different format widths of the individual strips to be cut. Above the support roller 8 is a roller 22 on a lateral pivot lever 23 bearing upon the support roll 8 and pressable thereagainst in a region thereof around which the web 1 is looped. The roll 22 serves, together with the support roll 8 to release the tension on the web ahead of the coiling stations 9 and 10. The tension downstream of the clamping point formed by the roller 22 and the roller 8 is controlled via the torque applied to the motors 17, 18 by a frequency converter to the requisite value for the desired coiling hardness. The tension for each of the coiled rolls 19, 20 can thus be controlled individually via the motor 17, 18 so that each of the coiling stations 9, 10 can be operated as an independent, self-standing coiling machine.

Preferably the coiling machine is used for producing rolls of large diameter (for example 1.5 m) of HWC-papers (high weight coated). These papers are sensitive to marking so that the line forces at the support roller 8 should be held to a minimum. Since the tension required for coiling the web 1 is applied by the drives 17, 18, the line forces with which the wound rolls 19, 20 press against the support roller 8 during the coiling can be held to values less than 30 N/m. The line forces however must be at least 10 N/m so that no air is wound into the coil and wound coiled rolls can be obtained even with profile fluctuations in the web 1.

I claim:

1. A device for winding up of material webs, especially paper webs or cardboard webs, transported along a web path, the device comprising:

slitting means along a web path for subdividing the web into individual strips;

a driven support roller downstream of the slitting means rotatable about a support axis and receiving the strips; and a pair of winding stations spaced radially from the support axis to opposite sides thereof for withdrawing the strips from the support roller, each of the winding stations comprising:

a plurality of winding brackets and movable radially toward and away from the support axis and displaceable parallel to the axis for coiling strips of different format, a respective angle drive mounted on each support element and displaceable therewith for rotatably driving a respective coiling roll winding up a respective strip, a respective electric motor connected with each angle drive and inclined to a horizontal, each electric motor being provided with a respective housing and each angle drive being provided with respective flanges for connecting with the respective motor, each motor being displaceable with the respective support element actuating the angle drive, and respective flexible cooling means providing a cooling medium for cooling the electric motor enabling shifting thereof along with a respective one of the support elements, each cooling means including:

bendable supply tubing conveying cooling liquid, circulating cooling passages formed in each housing, and cooling passages formed in each flange, so that the heat developed in each motor and each angle drive is carried off upon circulating of cooling liquid.

2. The device defined in claim 1, further comprising control means for controlling a torque of each of the electric motors thereby regulating a coil hardness of a respective coil roll.

3. The device defined in claim 2 wherein each motor is a polyphase asynchronous motor having a stator coil cooled with a liquid cooling medium selected from the group consisting of water and oil.

4. The device defined in claim 2 wherein the control means is a frequency converter controlling the electric motors.

5. The device defined in claim 1 wherein the motor is a direct current motor whose stator winding is cooled with a liquid cooling medium selected from the group consisting of water and oil.

* * * * *